US009598270B2

(12) United States Patent
Nielsen et al.

(10) Patent No.: US 9,598,270 B2
(45) Date of Patent: Mar. 21, 2017

(54) HIGH LIFT BAG DEVICE

(71) Applicant: Paratech, Incorporated, Frankfort, IL (US)

(72) Inventors: Kenneth E. Nielsen, Chicago, IL (US); William O. Teach, Frankfort, IL (US)

(73) Assignee: Paratech, Incorporated, Frankfort, IL (US)

( * ) Notice: Subject to any disclaimer, the term of this patent is extended or adjusted under 35 U.S.C. 154(b) by 95 days.

(21) Appl. No.: 14/732,321

(22) Filed: Jun. 5, 2015

(65) Prior Publication Data

US 2016/0355385 A1 Dec. 8, 2016

(51) Int. Cl.
*B66F 3/35* (2006.01)
*B66F 3/24* (2006.01)

(52) U.S. Cl.
CPC ..... *B66F 3/35* (2013.01); *B66F 3/247* (2013.01)

(58) Field of Classification Search
CPC ..... B66F 3/35; B66F 3/40; B66F 3/247
USPC ..... 254/93 HP, 93 H
See application file for complete search history.

(56) References Cited

U.S. PATENT DOCUMENTS 3,843,092 A * 10/1974 Oehler ..... B60P 1/02 254/2 R
3,982,731 A * 9/1976 Tezuka ..... B65G 7/04 254/93 HP
4,560,145 A * 12/1985 Widmer ..... B66F 3/35 254/93 HP
4,832,317 A * 5/1989 Alaphilippe ..... B29C 66/5344 156/73.1
5,506,012 A * 4/1996 Wright ..... B66F 3/35 254/93 HP
6,082,708 A * 7/2000 Mullican ..... B66F 3/35 254/93 HP
6,511,046 B1 * 1/2003 Solakian ..... B66F 3/35 254/93 HP
6,994,112 B2 * 2/2006 Garman ..... A47C 4/54 137/596.2
7,070,167 B1 * 7/2006 Bacon ..... B66F 7/0625 254/10 C (Continued)

OTHER PUBLICATIONS

Zumro Res Q, Zumro ResQ Catalogue, date unknown, pp. 1-11; www. zumroresq.com.

(Continued)

*Primary Examiner* — George Nguyen
(74) *Attorney, Agent, or Firm* — Banner & Witcoff, Ltd.

(57) ABSTRACT

A lifting device, configured to expand in a first direction between a deflated configuration and an inflated configuration upon being filled with compressed gas, may have a continuous surface including a bottom surface, a lower and upper intermediate surfaces and a top surface. A bottom plate may be coupled to at least part of bottom surface and a top plate may be coupled to at least part of the top surface. The continuous surface may include a plurality of surface undulations that provide a low height profile when in the deflated configuration and a higher height profile when in the inflated configuration. The plurality of surface undulations may vary between a first and second height when in the deflated configuration, but in the inflated configuration the variance between the relative heights of any remaining undulations is relatively smaller.

21 Claims, 8 Drawing Sheets

(56) References Cited

U.S. PATENT DOCUMENTS

| | | | | |
|---|---|---|---|---|
| 7,637,480 | B2 * | 12/2009 | Weinel | A62B 3/005 254/93 H |
| 8,052,120 | B2 * | 11/2011 | Bacon | B66F 7/0625 180/168 |
| 8,096,537 | B2 * | 1/2012 | Browne | F16B 1/0014 248/205.5 |
| 2008/0011989 | A1 * | 1/2008 | Davis | A61G 7/1021 254/93 HP |
| 2009/0140222 | A1 * | 6/2009 | Schwarz | A47F 1/06 254/93 HP |
| 2010/0117039 | A1 * | 5/2010 | Perrett | A61G 7/1021 254/93 HP |
| 2010/0264386 | A1 * | 10/2010 | Dvorak | B66F 3/35 254/93 HP |
| 2012/0248393 | A1 * | 10/2012 | Moore | B66F 3/35 254/93 HP |

OTHER PUBLICATIONS

"Individual Rescue Air Cushions," Paratech, http://www.paratech.com/product/individual-rescue-air-cushions; from Apr. 6, 2015, pp. 1-2.

"Res-Q-Tek NT Air Bags," Metadata of online version provides 2009 publication date, pp. 1-4.

"Hurst Jaws of Life Launches New Vetter Connectable Bags," dated Apr. 30, 2015; www.jawsoflife.com; pp. 1-2.

Maxiforce, Air Lifting Bags Brochure, Publication appears to be 2003, pp. 1-12.

"Fibre reinforcement structures of rubber products;" http://www.taniq.com/technology/fiber-reinforcement-structure.php; Mar. 30, 2012; pp. 1-2.

"Reinforced rubber technology and fibre reinforcement technology for rubber;" http://www.taniq.com/technology.php; Mar. 31, 2014; pp. 1-2.

* cited by examiner

HIGH LIFT BAG DEVICE

BACKGROUND

A lifting bag device may be utilized in time-sensitive or emergency situations to lift a first object from a second object or a surface. Many such situations involve a small clearance between the first object and the second object, in which the lifting bag device must be fitted into. Further, the first object may be of a substantial mass and may need to be lifted a certain height above the second object. Accordingly, aspects of this disclosure relate to an improved lifting bag device.

BRIEF SUMMARY

This Summary provides an introduction to some general concepts relating to this disclosure in a simplified form that are further described below in the Detailed Description. This Summary is not intended to identify key features or essential features of the disclosure.

According to one aspect, a lifting system may have a lifting bag configured to expand in a first direction between a deflated configuration and an inflated configuration upon being filled with compressed gas. The lifting bag may include a continuous surface including a bottom surface, a lower intermediate surface, an upper intermediate surface, and a top surface. Additionally, the bottom and lower intermediate surfaces may define a lower section and the top and upper intermediate surfaces may define an upper section positioned above the lower section along the first direction. A bottom plate may be coupled to at least part of the bottom surface and a top plate may be coupled to at least part of the top surface. The continuous surface may include a plurality of surface undulations that provide a low height profile of the lifting bag when in the deflated configuration and a higher height profile of the lifting bag when in the inflated configuration.

The plurality of surface undulations, in the deflated configuration, may have a height varying between a first deflated undulation height and a second deflated undulation height. When the lifting bag is in the inflated configuration, the height of any remaining surface undulations may vary between a first inflated undulation height and a second inflated undulation height, and the relative difference between the first and second deflated undulation heights may be greater than the relative difference between the first and second inflated undulation heights. In some examples, when the lifting bag is in the inflated configuration, the continuous surface has a relatively smoother surface as compared to the continuous surface in the deflated configuration. In certain embodiments, the relative difference between the first and second deflated undulation heights is greater than the relative height difference of any remaining features of the surface undulations.

The lower section and the upper section may be substantially spherically shaped when the lifting bag is in the inflated configuration. The lifting bag surface may comprise an aramid-reinforced neoprene. When the lifting bag is in the deflated configuration, the lower intermediate surface may folds over the bottom surface, and the top surface may fold over the upper intermediate surface.

According to another aspect, the top plate may have an interior top plate coupled to an exterior top plate. At least part of the top surface of the lifting bag may be compressed between the exterior and interior top plates. The bottom plate may have an interior bottom plate coupled to an exterior bottom plate. At least part of the bottom surface of the lifting bag may be compressed between the exterior and interior bottom plates. The bottom plate and the top plate may have raised dimple structures and the top plate may remain substantially parallel to the bottom plate as the lifting bag expands between the deflated configuration and the inflated configuration. The lifting bag may further include a middle plate disposed between the lower section and the upper section. The middle plate may be configured to resist an internal pressure exerted by a mass of air within the lower section. The middle plate may include a relief valve configured to provide pressurized gas from the lower section into the upper section upon the lower section reaching an inflated internal pressure value.

According to an aspect, the lifting system may further include a placement device having a base plate structure including one or more slider assemblies on a first side of the plate structure, a second flat side of the plate structure, and a handle connected to the base plate structure. A length of the base plate structure may be at least as long as a diameter of the lifting bag. The base plate structure may further include a frictional surface on, for example, a middle portion of the first side configured to provide friction between the placement device and a surface the placement device is resting on when the lifting bag is in the inflated configuration.

In another aspect, a lifting bag device may have a lower section defining a lower chamber and an upper section defining an upper chamber. The lower section may be configured to expand in a first direction between a deflated configuration and an inflated configuration upon being filled with compressed gas. The lower section may include a top surface and a bottom surface. Further, when the lower section is in the deflated configuration, the lower section top and bottom surfaces may include a plurality of surface formations. The height of the lower section surface formations may vary between a first formation height and a second formation height. Additionally, the upper section is configured to expand in a first direction between a deflated configuration and an inflated configuration upon being filled with a compressed gas. The upper section may include a top surface and a bottom surface. Further, when the upper section is in the deflated configuration, the upper section top and bottom surfaces may include a plurality of surface formations. The height of the upper section surface formations may vary between the first formation height and the formation second height. Further, the top surface of the lower section may be coupled to the bottom surface of the upper section. The lower section and upper section may have a combined first height and a combined first exterior surface area when each is in the deflated configuration and a combined second height and a combined second exterior surface area when each is in the inflated configuration. The second combined height may exceed the combined first height and the first exterior surface may be substantially equal to the second exterior surface area.

According to yet another aspect, a ratio of the combined second height to the combined first height may be at least 7. The combined first height may be between approximately of 2.5 inches and 5.0 inches, and the combined second height may be approximately 20 inches to 60 inches. The lifting device may include a bottom plate coupled to at least part of the bottom surface of the lower section, and a top plate coupled to at least part of the top surface of the upper section. At least one of the plates may have a relief valve configured to release pressurized gas out of the lifting device if an internal pressure of the lifting device meets or exceeds a maximum pressure. An internal pressure in the lower chamber, the upper chamber, or both, may reach approximately 150 psi when in the inflated configuration. The plurality of surface formations on the lower section and the upper section may include a plurality of undulations. The lifting device may further include a middle plate disposed between the lower chamber and the upper chamber. The middle plate may have a first relief valve configured to provide pressurized air from the lower chamber into the upper chamber upon the lower chamber reaching an inflated internal pressure value, and a second relief valve configured to provide pressurized air from the upper chamber to the lower chamber upon the lower chamber having a lower relative internal pressure than the upper chamber, and the middle plate may otherwise be configured to restrict airflow from passing therethrough. When the lower section and the upper sections are in the deflated configuration, the top section surfaces may fold on top of the bottom section surfaces.

In yet another aspect, a lifting device may have a lifting bag that expands in a first direction between a deflated configuration and an inflated configuration upon being filled with compressed gas. The lifting bag may have a top surface and a bottom surface. A top plate may be coupled to the top surface of the lifting bag and a bottom plate may be coupled to the bottom surface of the lifting bag. Additionally, when the lifting bag is in the deflated configuration, the top and bottom surfaces may have a plurality of undulating arcs between a first edge defining an interior circumference of the lifting bag and a second edge defining an exterior circumference of the lifting bag and, when the lifting bag is in the inflated configuration, the top and bottom surfaces may define the shape of a substantially circular arc between the first edge and the second edge of each surface. The lifting device may have an upper intermediate surface and a lower intermediate surface between the top surface and bottom surface such that the bottom and lower intermediate surfaces define a lower section, and the top and upper intermediate surfaces define an upper section.

BRIEF DESCRIPTION OF THE DRAWINGS

The present disclosure is illustrated by way of example and not limited in the accompanying figures in which like reference numerals indicate similar elements and in which.

Further, it is to be understood that the drawings may represent the scale of different component of one single embodiment; however, the disclosed embodiments are not limited to that particular scale.

DETAILED DESCRIPTION

In the following description of various examples of lifting device systems and lifting devices of the this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Aspects of this disclosure relate to a lifting device or lifting device system including a lifting bag configured to be inflated in order to lift, or otherwise move a first object away from a second object or surface. In particular, the described lifting bag may include a continuous surface. In some examples, the continuous surface includes a bottom surface, a lower intermediate surface, an upper intermediate surface, and a top surface. The bottom and lower intermediate surfaces, in turn, may define a lower section and the top and upper intermediate surfaces may define an upper section. Further, when the lifting bag is in the deflated configuration, the continuous surface may include a plurality of surface undulations or other formations (e.g. shapes of varying heights, wherein the heights may vary within a certain height range) that provide a low height profile of the lifting bag. In some examples, when the lifting bag is in the inflated configuration, the plurality of surface undulations or formations may have a smaller variation or variations in height, as compared to the variation or variations in height in the deflated configuration, and the lifting bag may have an overall higher height profile.

In the following description of the various embodiments, reference is made to the accompanying drawings, which form a part hereof, and in which is shown by way of illustration various embodiments in which aspects of the disclosure may be practiced. It is to be understood that other embodiments may be utilized and structural and functional modifications may be made without departing from the scope and spirit of the present disclosure.

Figure 1:
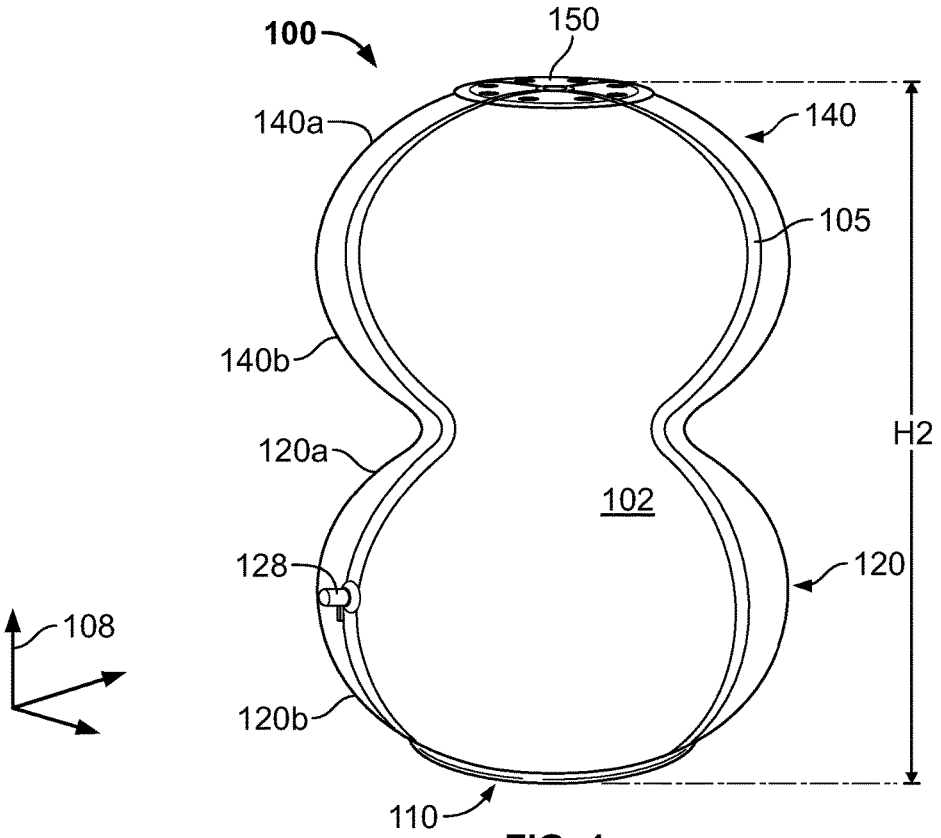
FIG. 1 depicts an isometric view of a lifting device in an inflated configuration, according to one or more aspects described herein.

FIG. 1 schematically depicts an isometric view of a lifting device 100. In one example, the lifting device 100 may be utilized by emergency service personnel, or other users, in time-sensitive situations when there is a need to lift, or otherwise separate a first object from a second object or surface. In this regard, the lifting device 100 may be utilized to, in one example, lift a portion of a vehicle following a collision, or a section of a collapsed structure. In other examples, the lifting device 100 may be utilized to raise a portion of a vehicle to facilitate tire repair, jack a portion of a vehicle, position heavy machinery, or to pry open a gap between two structures to free a trapped person or object, among others. However, additional applications for the lifting device 100 may be envisioned beyond the examples presented herein, and without departing from the scope of these disclosures.

Figure 2:
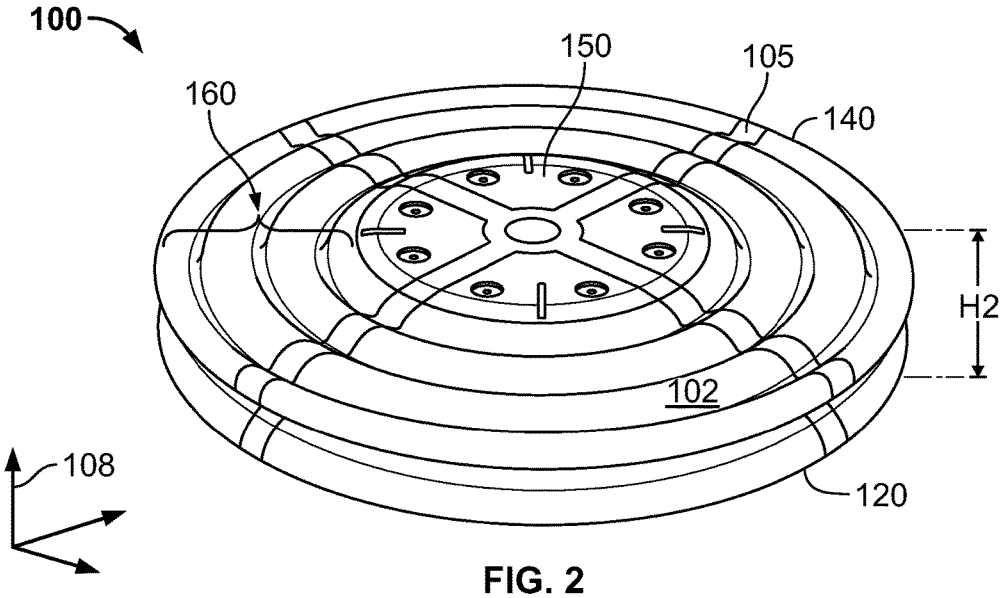
FIG. 2 depicts an isometric view of a lifting device in a deflated configuration, according to one or more aspects described herein.

In one implementation, the lifting device 100, otherwise referred to as a lifting bag device or an emergency lifting device, may have a lower section 120 defining a lower chamber and an upper section 140 defining an upper chamber, although in some embodiments the device may comprise a section or sections defining one chamber, or more than two chambers. The lower section 120 and upper section 140 may each be configured to expand substantially along a first direction 108 upon being filled with a compressed gas (e.g. air, oxygen, nitrogen, helium, among others, or a combination of two or more gases). As such, FIG. 1 schematically depicts the lifting device 100 in an inflated, or expanded, configuration. In turn, FIG. 2 schematically depicts the lifting device 100 in a deflated, or contracted, configuration.

In one example, the lower section 120 may have a lower intermediate or top surface 120*a* and a bottom surface 120*b* and the upper section 140 may have a top surface 140*a* and an upper intermediate or bottom surface 140*b*. As depicted in FIG. 1, the top surface 120*a* of the lower section 120 may be coupled to the bottom surface 140*b* of the upper section 140, e.g., by a continuous surface forming and defining these sections. Accordingly, the upper section 140 may be positioned above the lower section 120 along the first direction 108.

In one example, the lower section 120 and upper section 140 may comprise a continuous surface that defines a lifting bag 102. The lifting bag 102 may be constructed from an aramid-reinforced neoprene. In one specific example, sidewalls of lifting bag 102 may comprise one layer of an aramid material to reinforce a neoprene material. In other examples, however, the lifting bag 102 may utilize more than one layer of an aramid material to reinforce a neoprene material, without departing from the scope of these disclosures. In other example embodiments, one or more layers or other applications (e.g. a partial layer or multiple partial layers, either standing alone or in addition to at least one complete layer) of other reinforcement material(s), e.g., other fiber material(s), may be used in addition to or in place of aramid material. In some example embodiments, other material(s), e.g., other rubber and/or polymer material(s), may be used in addition to or in place of neoprene material.

The lifting bag 102 may be formed initially with dimensions substantially similar to an inflated configuration using a base mold. In one implementation, the surface of the lifting bag 102 includes an aramid fiber sandwiched or wrapped between layers of rubber, where the rubber outside surface may be easily separated from the base mold after initial formation of the layers. Accordingly, the lifting bag 102 may have an even continual weave of aramid and/or other fiber reinforcement within the, e.g. neoprene layers. A continual, non-overlapping aramid-reinforced neoprene layer may enhance a maximum lift provided by the lifting device 100 by strengthening the surface of the lifting bag 102 when in the inflated configuration. When molding the formed structure of lifting bag 102, surface features associated with the molded configuration may be provided by vulcanizing the surface into a different profile than the initially formed profile to achieve a low insertion height (by, e.g. adding undulations to the surface), as described herein, without changing or significantly changing the external surface area of the surface of the bag. This may be done using a vulcanization mold providing a shape corresponding to the desired shape of the deflated configuration of the lifting bag (for example, using an exterior mold and an interior mold with the formed rubber/fiber layers in between). Thus, in the deflated configuration, the lifting bag 102 may have a low insertion profile with a low first height H1, and, in the inflated configuration, the lifting bag 102 may have a second height H2 greater than the first height and a high strength lift capacity.

In one example, as depicted in FIG. 1, a bottom plate 110 may be coupled to at least part of bottom surface 120*b* of lower section 120 and a top plate 150 may be coupled to at least part of the top surface 140*a* of the upper section 140. In one implementation, the bottom plate 110 and/or the top plate 150 may include a dimpled structure and/or other frictional features. As such, the raised dimples may be configured to provide added traction, such that the lifting device 100 may grip to one or more surfaces with which it is placed in contact. In one example, the dimples of the top plate 150 and/or the bottom plate 110 may be embodied with any size, without departing from these disclosures. Similarly, the top plate 150 and/or the bottom plate 110 may be embodied with additional or alternative grip textures/patterns, without departing from the scope of these disclosures.

The bottom plate 110 and/or the top plate 150 may be formed using a variety of materials, including any of the materials discussed above in reference to the lower section 120 and upper section 140. In one implementation, the bottom plate 110 and/or the top plate 150 may comprise one or more metal or alloy elements, including but not limited to a high strength, lightweight aluminum, stainless steel or steel.

The lifting device 100 may be expanded from the deflated configuration depicted in FIG. 2 to the inflated configuration depicted in FIG. 1 by filling the lower section 120 and the upper section 140 with one or more compressed gases (e.g. air, oxygen, nitrogen, helium, among others). As such, the compressed gas may be introduced into a cavity of the lower section 120 through an inlet 128, and from a gas source line (e.g. compressed air hose). In one example, at least a portion of inlet 128 may be molded into the surface of the lower section 120. The inlet 128 may be utilized to inject compressed gas (e.g. air) into the lower section 120 and, in some embodiments, through the lower section 120 and into the upper section 140, as described herein. In one example, a compressed gas may be injected into the lifting device 100 through an inlet hose (e.g. a gas source line). In one example, the inlet 128 may be configured to receive a coupler device (e.g. an air hose nipple or an inflation nipple). As such, various configurations of the coupler device (e.g. industrial standard air coupling configurations, among others) may be utilized to couple to the inlet 128, without departing from the scope of these disclosures. However, when the lifting device 100 is stored, or being deployed (e.g. before an inlet hose is connected), a protective cap may be received into the inlet 128. As such, the protective cap may prevent debris from entering into the inlet 128. In one example, the inlet 128 may extend through the surface of the lower section 120 and into and interior portion thereof. In one implementation, a portion of the inlet 120 may extend outward from the surface of the lower section 120 with an inlet length which may be embodied with any dimensional values, without departing from the scope of this disclosure. In various examples, the inlet length is approximately 0.875 inches. In some examples a length of the inlet 128 is between approximately 0.8 inches and 1.0 inches, while in others it is about 1.0 inches or less, or 0.8 inches or less.

In one example, the inlet 128 may comprise a structure constructed from one or more metals or alloys. In one example, the inlet 128 may comprise a brass structure. In other examples, the inlet 128 may be constructed from a steel or an aluminum (or alloys thereof), among others. In one implementation, the inlet 128 may comprise a bore configured to receive one or more standardized coupling sizes, and in particular may have a portion of an axial length with a threaded sidewall. As such, the bore, and the threaded sidewall may comprise any diameter and/or thread size known to those of ordinary skill in the art. In one implementation, the inlet 128 may be configured to receive standardized couplings configured to handle compressed gas (e.g. compressed air). In one example, the inlet 128 may be configured to receive a threaded nipple device (e.g. air hose nipple). In some examples, the inlet may comprise one or more projections that extend in a radial direction relative to the to the inlet, which may rest against an internal surface of the bag or device to help resist an internal pressure from within the bag or device so the inlet remains in place.

The lower section 120 and upper section 140 may expand in the first direction 108, between a deflated configuration, as depicted in FIG. 2, and an inflated configuration, as depicted in FIG. 1, upon being filled with compressed gas. The lower section 120 and upper section 140 may have a combined first height H1 and a combined first exterior surface area A1 when each is in the deflated configuration, e.g., as depicted in FIG. 2, and a combined second height H2 that exceeds the first height H1 and second exterior surface area A2 that is substantially equal to the first exterior surface area A1 when the lower section 120 and upper section 140 are each in the inflated configuration, e.g., as depicted in FIG. 1. In one example, a ratio of the second height H2 to the first height H1 may be at least 7. In another example, the ratio of the second height H2 to the first height H1 may range from approximately 5 to 15. In one example, the first height H1 may range from approximately 2.5 inches (approximately 63.5 mm) to 5.0 inches (approximately 127 mm). In one example, the second height may range from approximately 20 inches (approximately 0.5 m) to 60 inches (approximately 1.5 m). In other examples, the second eight may be at least 12 inches, at least 25 inches, at least 35 inches, at least 45 inches, or at least 55 inches, among others. In another example, the first height H1 may be less than 2.5 inches or more than 5.0 inches, and/or the second height H2 may be less than 20 inches or more than 60 inches without departing from the scope of these disclosures.

The lifting device 100 may be configured to expand to a maximum lifting height, i.e. the second height H2, associated with an inflated configuration. In one implementation, the maximum lifting height may be reached when an internal pressure in the lower section 120 and the upper section 140 each reach approximately 150 psi (approximately 10.3 bar). In another implementation, the internal pressure in the lower section 120 and the upper section 140 may be at least 140 psi (approximately 9.7 bar) or in a range between 140 psi and 150 psi when the maximum lifting height is reached. In one example, the lifting height may range from approximately the first height H1, when the lower section 120 and upper section 140 are each in the deflated configuration to the second height H2, when the lower section 120 and the upper section 140 are each in the inflated configuration. In another implementation, the lifting device 100 may be configured to expand to different heights, e.g., at various intervals between the first height H1 and the second height H2, without departing from the scope of these disclosures.

In one implementation, when in the inflated configuration, lower section 120 may have a first geometry (e.g. a substantially spherical shape, as depicted in FIG. 1), and the upper section may have a second geometry (e.g. also a substantially spherical shape, as depicted in FIG. 1). In other examples, the lower section 120 and upper section 140 may have varying geometries of other curved shapes when in the inflated configuration, e.g., shapes that are substantially elliptical, cylindrical, frustoconical, and the like, or geometric shapes such as square, rectangular, pentagonal, hexagonal, triangular and the like.

In one implementation, the lower section 120 and/or the upper section 140 may each have a substantially spherical shape when in the inflated configuration and a substantially circular disc shape when in the deflated configuration. In particular, the lower section 120 and/or the upper section 140 may each have a length, a width, and a thickness when in a deflated configuration. In one implementation, the length may be approximately equal to the width. However, in another implementation, the length may not be equal to the width and such that device 100 has, e.g., a substantially elliptical shape when in a deflated configuration.

In one example, a height to which the lower section 120 and the upper section 140 may expand to an inflated configuration (e.g. along the first direction 108 to height H2), may depend upon the size of the lower section 120 and/or the upper section 140 (e.g. length and width, amount of surface area). In one example, the length of each section may range from approximately 6 inches (approximately 152 mm) to approximately 37 inches (approximately 939 mm). Further, the width may range from approximately 6 inches (approximately 152 mm) to approximately 37 inches (approximately 939 mm). In yet another implementation, the length and width may be embodied with any dimensional values below 6 inches, or above 37 inches, without departing from the scope of these disclosures.

The expanded configuration of the lower section 120 and/or the upper section 140, as depicted in FIG. 1, may be reached when an internal pressure in each section reaches approximately 150 psi (approx. 10.3 bar). However, in other implementations, the inflated configuration, as depicted in FIG. 1, may be reached when an internal pressure in the lower section 120 and/or the upper section 140 reaches a pressure value in the range of 50 psi to 400 psi (approx. 3.4 bar to 27.6 bar). Further, the lifting device 100, including various sub-components described throughout this disclosure, may be configured to withstand an internal pressure within the cavities of the lower section 120 and/or the upper section 140 of at least approx. 600 psi (approx. 41 bar) before failure. In other examples, the lifting device 100 may be configured to withstand an internal pressure within a cavity of the lower section 120 and/or the upper section 140 of at least approximately 200 psi (approx. 13.8 bar), at least approximately 300 psi (approx. 20.7 bar), at least approximately 400 psi (approx. 27.6 bar), at least approximately 500 psi (approx. 34.5 bar), at least approximately 700 psi (approx. 48.3 bar), or at least approximately 800 psi (approx. 55.2 bar), among others.

In one implementation, the lifting device 100 may be configured to lift a mass ranging from up to approximately 1.5 tons (approximately 1360 kg). In another implementation, the lifting device 100 may be configured to lift a mass ranging from approximately 1.5 tons to approximately 90 tons (approximately 81,646 kg). In some embodiments, the lifting device 100 may be configured to lift a mass ranging from approximately 1.5 tons to approximately 31 tons, in certain embodiments from approximately 1.5 tons to approximately 60 tons, and in some examples from approximately 1.5 tons to approximately 90 tons. In certain embodiments, the lifting device 100 may be configured to lift a mass ranging from approximately 25 tons to approximately 90 tons, in certain embodiments from approximately 40 tons to approximately 90 tons, and in some examples from approximately 70 to approximately 90 tons. However, the lifting device 100 may be configured to lift a mass below 1.5 tons, or above 90 tons, without departing from the scope of these disclosures.

In one implementation, the lifting device 100 may include a marking 105 to indicate a center of the lifting device 100. In one example, and as schematically depicted FIG. 2, the marking 105 may be approximately "X" shaped, and such that a center of the "X" shaped marking corresponds to a center of the lifting device 100. However, additional or alternative symbols may be utilized in place of marking 105 to indicate a center of the lifting device 100, without departing from the scope of these disclosures (e.g. bull's-eye symbol, among others).

The top surface 120*a* and the bottom surface 120*b* of the lower section 120 and top surface 140*a* and the bottom surface 140*b* of the upper section 140 may each be substantially parallel when the lifting bag is in a deflated configuration, as depicted FIG. 2. In one example, when the lower section 120 and upper section 140 are each in the deflated configuration, the lower section top surface 120*a* surface folds over the lower section bottom surface 120*b*, and the upper section top surface 140*a* folds over the upper section bottom surface 140*b*. In contrast, FIG. 1 schematically depicts the lifting device 100 in an inflated configuration in which the lower section 120 and upper section 140 are substantially spherical. As depicted in FIGS. 1 and 2, the top plate 150 may remain substantially parallel to the bottom plate 110 as the lower section 120 and upper section 140 expands between the deflated configuration and the inflated configuration.

Figure 10:
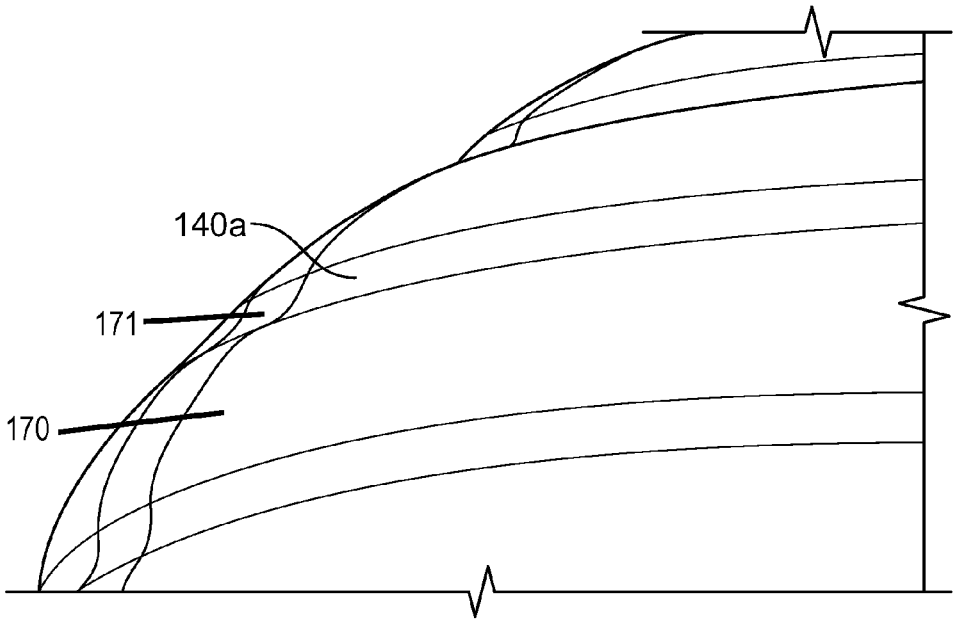
FIG. 10 depicts an isometric view of a portion of a lifting device in an inflated configuration.

When in the deflated configuration, as depicted in FIG. 2, the lower section 120 and the upper section 140 may include a plurality of surface formations 160, e.g., surface undulations, varying between a first formation height and a second formation height. When in the inflated configuration, as depicted in FIG. 1, the surface formations 160 may have a reduced difference between the first formation height and the second formation height. In other words, upon inflating the lifting device 100 and expanding the height of the lifting device 100 along the first direction 108, the surface of the lifting device, and its surface formations 160 of varying heights in the deflated configuration, may deform from their deflated configuration state to form a smoother surface when in the inflated configuration, thus reducing the variation between the first formation height and the second formation height of the surface formations 160. FIG. 10 shows a representative example inflated surface of top section 140*a*. As illustrated in this example, the undulations or formations of varying height may remain, in reduced form, or features thereof may remain, when the device in the inflated configuration due to the characteristics and shape of the vulcanized deflated profile.

Accordingly, the surface formations 160 (for example, undulations, arcs, or a series of geometric features of varying heights (such as repeating triangular, or trapezoidal features)) may provide a low height profile in the deflated configuration, as they allow additional surface area to be contained within a smaller height range, and a substantially higher height profile and high lifting capability in the inflated configuration, as this additional surface area allows, e.g. a larger inflated chamber.

Figure 3:
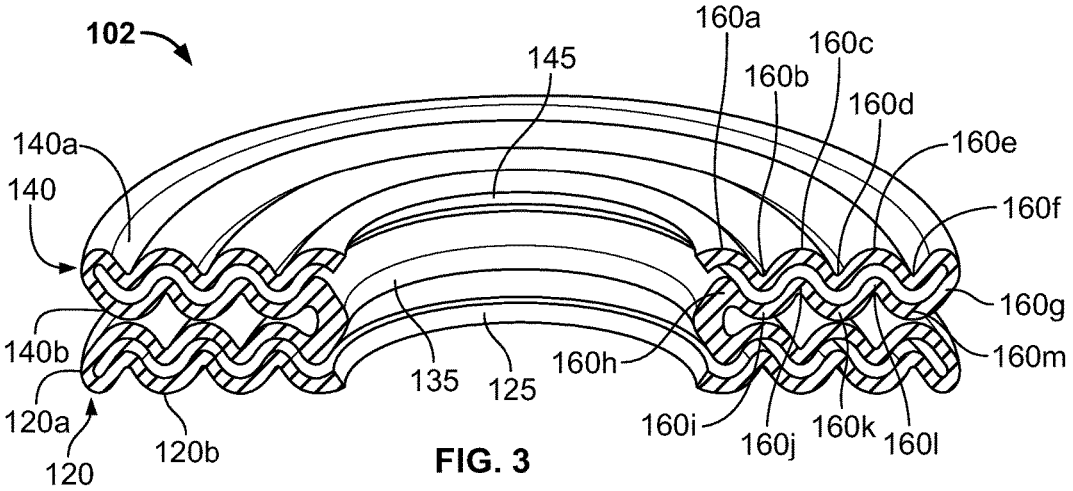
FIG. 3 schematically depicts a cross-sectional view of a portion of a lifting bag, according to one or more aspects described herein.

FIG. 3 schematically depicts a cross-sectional view of a portion of the lifting bag 102 as molded into a deflated configuration, without end plates 110, 150. A plurality of surface formations 160 are shown along the cross section of the lifting device 100 and ending at a top edge surface 145 of the upper section 140, a bottom edge surface 125 of the lower section 120, or a middle edge surface 135. For example, the upper section top surface 140*a* includes a plurality of peaks 160*a*, 160*c*, and 160*e* and a plurality of valleys 160*b*, 160*d*, and 160*f*. In this manner, the surface may define a first undulation height (e.g. the peak) and a second undulation height (e.g. the adjacent valley), and when the lifting bag is in the deflated configuration, and the plurality of surface undulations may provide a low height profile of the lifting bag while having a height varying between a first deflated undulation height and a second deflated undulation height. In other examples, the first and second undulation heights may be defined by the top and bottom of other shapes, such as a triangular or trapezoidal formation. A variety of arc shapes, radii and curvatures may be used for the undulations. In some examples, the size, shape, degree of curvature/angles of relative surfaces of the formations or undulations may vary, or may change based on the section of the lifting bag. Thus in some embodiments, the variance in height of the deflated undulations or formations may vary, where larger undulations or formations may define the variance in height range, while certain others are contained entirely within the range or a subset of the range.

Similarly, the upper section bottom surface 140*b* includes a plurality of peaks 160*h*, 160*j*, and 1601 and a plurality of valleys 160*i*, 160*k*, and 160*m*. As depicted in FIG. 3, the plurality of peaks and valleys of the upper section top surface 140*a* may respectively overlap the plurality of peaks and valleys of the upper section bottom surface 140*b*. Similarly, the plurality of peaks and valleys of the lower section top surface 120*a* may respectively overlap the plurality of peaks and valleys of the lower section bottom surface 120*b*. Overlapping of the peaks and valleys of surface formations 160 (or other corresponding features, such as corresponding geometric shapes, e.g. repeated triangular shapes that "fit" together) in the deflated configuration may further reduce the first height of the lifting device, improving its low insertion profile. In some examples, the surface formations 160 may substantially flatten out when in the inflated configuration such that the lower section 120 and upper section 140 each have a substantially smooth shape, such as a smooth spherical shape.

As illustrated in FIG. 10, when the lifting bag is in the inflated configuration, the height of any remaining surface undulations may still vary, but in a less pronounced manner to provide a smoother surface. In some examples, a majority of the surface area is smooth or substantially smooth, and only small area(s) of undulation remains or features of the deflated undulations (or formations) remain. As one example, the example shown in FIG. 10, relatively smaller areas defining channels or indentations, corresponding to the bottom of any valleys from the deflated configuration are present in the inflated configuration. Thus, in some examples, any areas retaining a feature of a undulation/formation in the inflated configuration may be interspersed between areas that are smooth or substantially smooth, where such areas may partially define an overall inflated shape of the lifting device. In other examples, however, even in the inflated configuration, the lifting device surface may entirely comprise surface undulations, but of a compressed or lower variance nature when compared to the undulations of the deflated configuration.

wherein, when the lifting bag is in the inflated configuration, the continuous surface has a relatively smoother surface as compared to the continuous surface in the deflated configuration, and wherein the relative difference between the first and second deflated undulation heights is greater than the relative height difference of any remaining features of the surface undulations, and wherein the lifting bag has a higher height profile in the inflated configuration.

Again turning to FIG. 10 as an example, the continuous surface (here, section 140*a*) has a relatively smoother surface as compared to the continuous surface in the deflated configuration. And as illustrated in this example embodiment (in comparison to, e.g. the example embodiment shown in FIG. 3), the relative difference between the first and second deflated undulation heights may greater than the relative height difference of any remaining features of the surface undulations. In some examples, the height of any remaining undulation features may vary between a first inflated undulation height (e.g. the apex of the relatively smooth surface 170) and a second inflated undulation height of an adjacent feature (e.g. the bottom of the recess channel 171). By virtue of the inflation and the expansion of the surface, the relative difference between the first and second deflated undulation heights for an undulation may be greater than the relative difference between the first and second inflated undulation heights of the corresponding undulation feature (taking into account any curvature of the overall inflated shape of the lifting bag). Likewise, the variance in height of other formations of varying height (e.g. triangular shapes) may be greater in the deflated configuration than in the inflated configuration.

Figure 4:
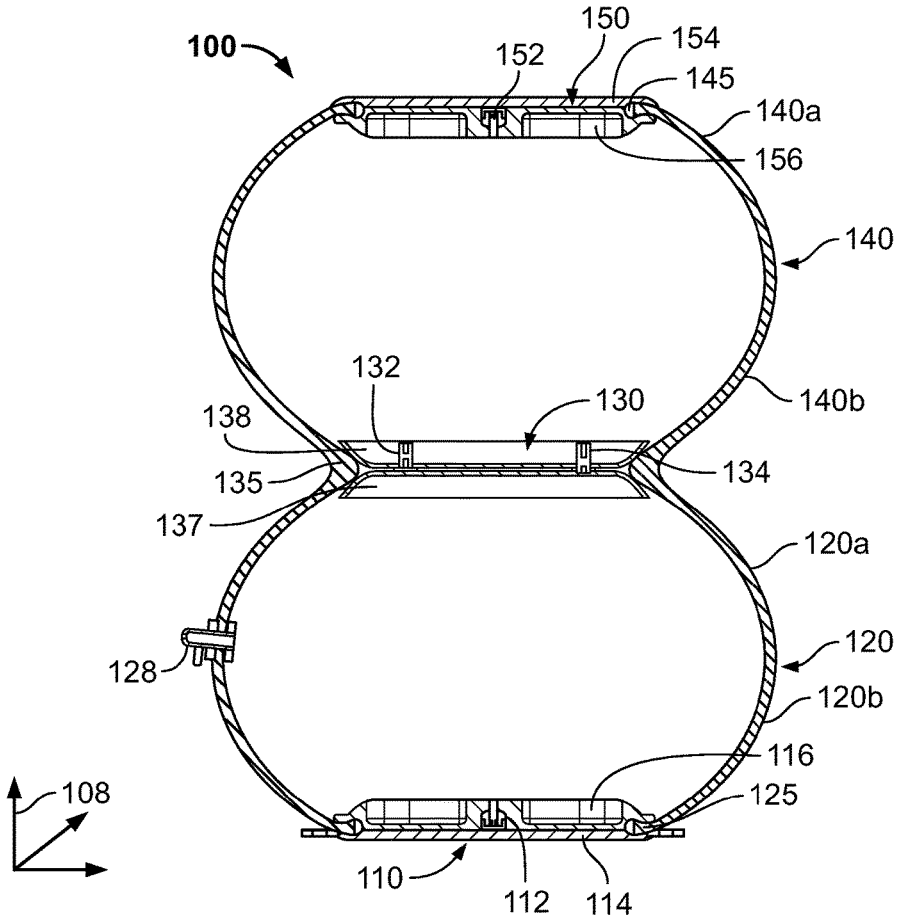
FIG. 4 schematically depicts cross-sectional view of a lifting device, according to one or more aspects described herein.

FIG. 4 schematically depicts a cross-sectional view of a portion of the lifting device 100 in an inflated configuration. In an example, the top plate 150 may have an interior top plate 156 coupled to an exterior top plate 154. The top edge portion 145 of the upper section 140 may be compressed between the exterior top plate 154 and interior top plate 156 to seal the upper section 140 to the top plate 150. In an example, bottom plate 110 may have an interior bottom plate 116 coupled to an exterior bottom plate 114. The bottom edge portion 125 of the lower section 120 may be compressed between the exterior bottom plate 114 and interior bottom plate 116 to seal the lower section 120 to the bottom plate 110. In this manner, an internal pressure only acts upon the interior plate, and the exterior plate only acts to seal a portion of the surface while the internal pressure does not act upon the exterior plate itself. The bottom edge portion 125 may be substantially parallel to the exterior bottom plate 114 and interior bottom plate 116. Similarly, the top edge portion 145 may be substantially parallel to the exterior top plate 154 and the interior top plate 156. In other examples, only a radial or external portion(s) of the plates are substantially parallel. In certain examples, an edge of the plate or plates may be curved or angled to match an incoming curvature of the continuous surface. In some implementations, top plate 150 and bottom plate 110 may each be a single plate configuration with any suitable coupling feature at an edge thereof for receiving or fastening the top edge portion 145 and the bottom edge portion 125, respectively. In some examples, the interior and exterior plates are coupled together using one or more screws or other fasteners.

The lifting device 100 may have a middle plate 130 disposed between the lower section 120 and the upper section 140. In one example, middle plate 130 may be affixed into place after the mold process using, e.g. a glue. In another example, middle plate 130 may be molded in place during the mold process. Middle plate 130 may have a rubber seal overmolded onto its surface or a portion of its surface (e.g. an exterior diameter), for example by overmolding a rubber ring or seal onto a tapered surface of the middle plate 130. In one implementation, middle plate 130 may be configured to resist an internal pressure exerted by a mass of air within the lower section 120. The middle plate 130 may include an upper middle plate 138 which is coupled to a lower middle plate 137. In some examples, the middle plate may be entirely configured to restrict airflow from passing therethrough. In certain of these embodiments, the lifting device comprises at least two external air inlets for filling of each chamber.

In other examples, the middle plate 130 may include first relief valve 132 to provide pressurized gas from the lower section 120 into the upper section 140 upon the lower section 120 reaching an inflated internal pressure value. In some examples, the valve provides pressurized gas upon the lower section reaching a pressure of approximately 20 psi or more. In other examples, it provides gas upon the lower section reaching a pressure of approximately 75 psi or more, or approximately 140 psi or more, or approximately 150 psi. In another example, the middle plate 130 may have a first relief valve 132 to provide pressurized air from the lower section 120 into the upper section 140 upon the lower section 120 reaching an inflated internal pressure value, and a second relief valve 134 to provide pressurized air from the upper section 140 to the lower section 120 upon the lower section 120 having a lower relative internal pressure than the upper section 140. Besides the first relief valve 132 and the second relief valve 134, the middle plate 130 may otherwise be configured to restrict airflow from passing therethrough. The middle plate 130 may form separate internal chambers, e.g., the lower section 120 and upper section 140. Accordingly, lower section 120 may first inflate to the inflated configuration. Once the lower section 120 has reached an internal pressure associated with the inflated configuration, first relief valve 132 opens to provide pressurized air to the upper section 140. Upon release, the second relief valve 134 releases airs from both sections at the same time.

In an example, the bottom plate 100 may have a relief valve 112 and/or the top plate 150 may have a relief valve 152 to release pressurized gas out of the lifting device 100 if an internal pressure of the lifting device 100 meets or exceeds a maximum pressure. In one example, relief valves 112, 132, 134 and 152 may each be bolted in their respective end plates. In another example, relief valve 112 may be provided on the bottom interior plate 116 and relief valve 152 may be provided on top interior plate 156. Top plate 150 and bottom plate 110 may each comprise solid surfaces oriented towards the internal pressure such that the force of the internal pressure pushes entirely on the interior plates rather than fastening devices between the interior and exterior plates (e.g. the fasteners are screws that extend into the plate, but not entirely though it to reach the interior side of the plate).

Figures 5A, 5B, 5C:
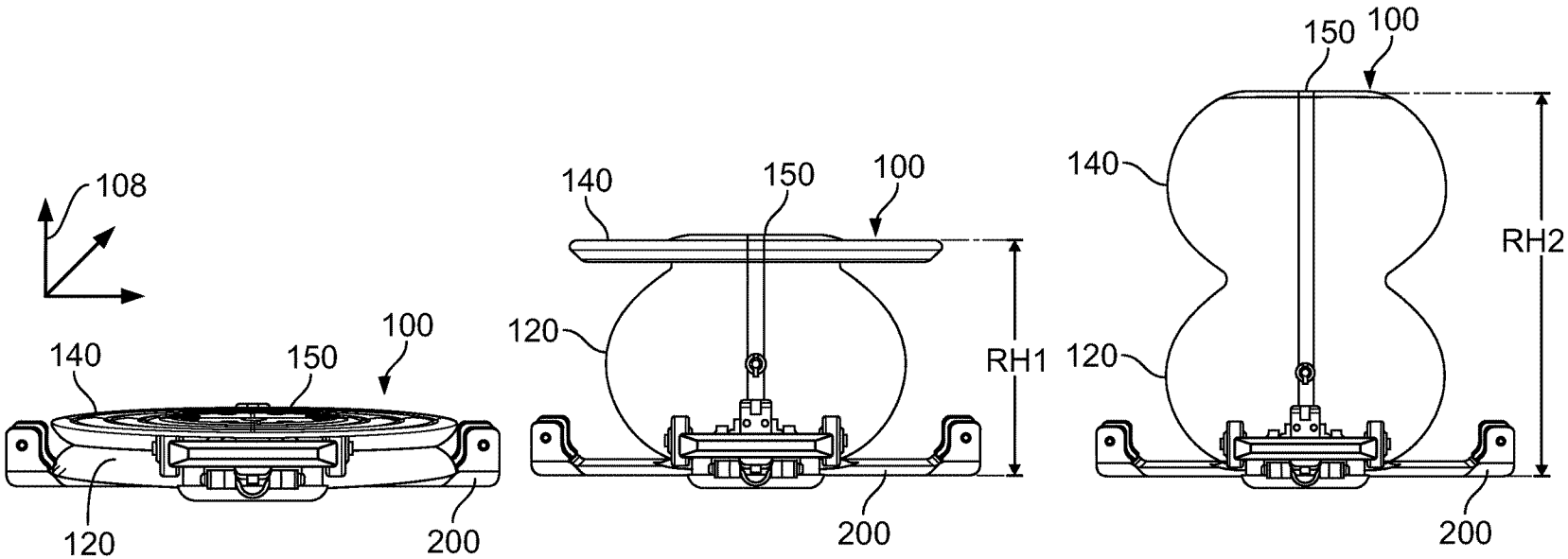
FIGS. 5A-C depict a side views of a lifting device system with lower and upper sections in a deflated condition, with the lower section in an inflated condition and the upper section in a deflated condition, and with the lower and upper sections in an inflated configuration, respectively, according to one or more aspects described herein.

In one example, the lower section 120 and/or the upper section 140 may be configured to expand substantially along direction 108 (i.e. along the direction of the arrow 108, or along the associated negative direction of arrow 108 (180° opposite direction to arrow 108)). In one implementation, as the lower section 120 is expanded from a deflated configuration, as depicted in FIG. 5A, to an inflated configuration, as depicted in FIG. 5B, the upper section 140 may remain deflated and the lifting device 100 may expand to a first raised height RH1. As discussed above, upon the lower section 120 being expanded to the inflated configuration, the upper section 140 may expand to an inflated configuration, as depicted in FIG. 5C, such that both the lower section 120 and the upper section 140 are in the inflated configuration and the lifting device 100 expands to a second raised height RH2, e.g., approximately two times the height of the first raised height RH1. By filling each section in a quantized manner, the lifting device 100 may be configured to lift an object more stably.

Figure 6A:
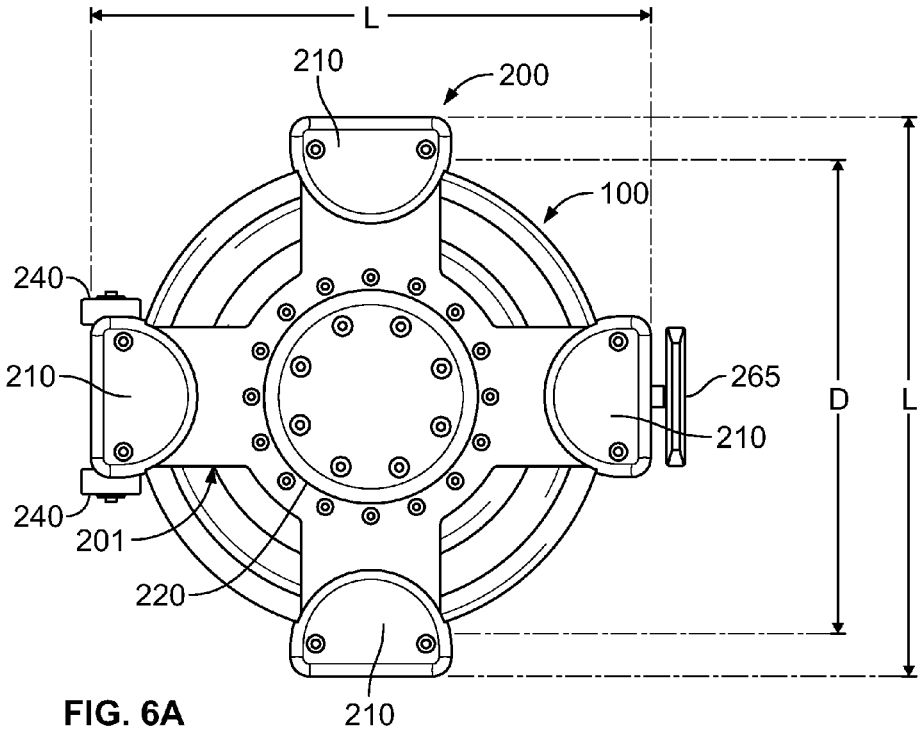
FIGS. 6A and 6B depict bottom and top views, respectively, of a lifting device system, according to one or more aspects described herein.
Figure 6B:
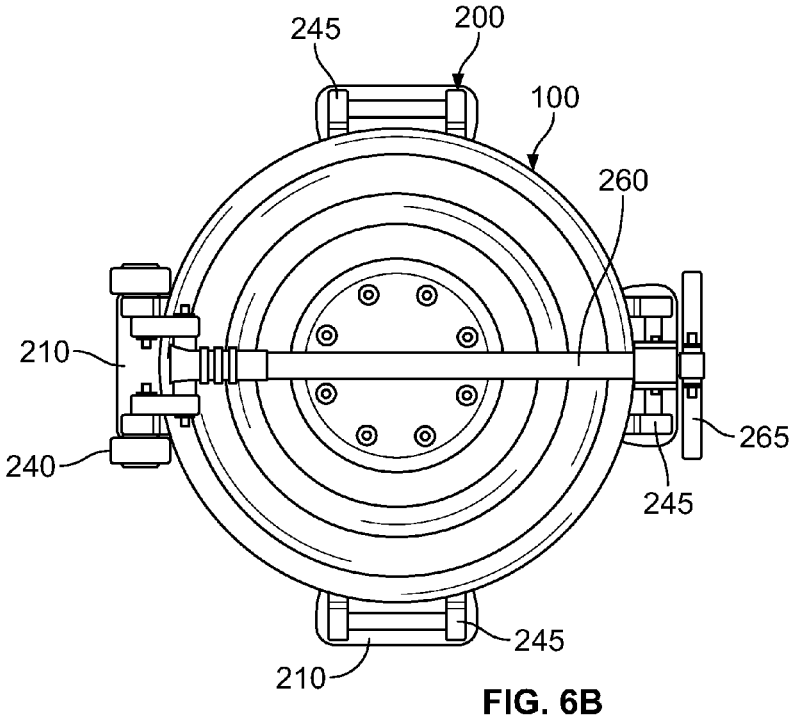

In one example, a lifting system may comprise a lifting device 100 and a placement device 200. As shown in FIGS. 6A and 6B which schematically depict bottom and top views, respectively, of a lifting system that includes a lifting device 100 and a placement device 200. The placement device 200 may have a base plate structure 201 with a plurality of low friction surfaces, such as slider assemblies 210. In certain examples, the base plate 201 is "X" shaped, but other shapes, such as circles, or shapes corresponding to the shape of the lifting device, are possible. In one example, the base plate structure 201 may be comprised of polyethylene, or other suitable flexible materials that would not be permanently deformed by any force resulting from the inflation and lifting process. In various examples a middle portion 220 of the base plate structure 201 may have a hole substantially the same size and shape as bottom plate 110 of the lifting device 100 such that the bottom plate 110 of the lifting device is in contact with a surface the lifting system rests on to provide friction thereto, for example when the device is partially or entirely inflated and the bottom plate is pushed downward from the internal pressure and the weight of the lifted object(s). In another example, a middle portion 220 of the base plate structure 201 may include a plate with a dimpled structure similarly providing friction on a surface the lifting system is placed on. In other examples, both sides of the middle portion 220 may comprise a frictional surface(s), to provide friction between the lifting device 100 and the placement device 200, and in turn between the placement device 200 and the lifting surface 100, such as the ground.

A length L of the base plate structure 201 may be at least as long as a diameter D of the lifting device 100. Accordingly, the base plate structure 201 may have a larger cross sectional area than a cross sectional area of lifting device 100, thus providing greater stability to the lifting device 100 when in the inflated configuration. In an example as depicted in FIG. 6A, the base plate structure 201 may have four "X" points. Ends of the four "X" points, e.g., where low friction slider assemblies 210 are located, may be configured to support the lifting device 100 on its own when in the inflated configuration. One or more transport assemblies 240, such as a set of wheels, rollers and the like (or even other low friction surfaces designed to be in contact with the ground at different orientations than the slider assemblies), may be provided or connected on a second side of the base plate structure 201, for example, at an end of an "X" point. For example, the lifting system may be lifted up and rested on a transport assembly (e.g. the wheels of FIG. 6A and 6B), and easily transported (e.g. rolled) as a user grasps another part of the device, such as the handle 265. The first side of the base plate structure 201 may include the slider assemblies 210 that provide low friction surfaces which allow, when the placement device is set down on the surface (e.g. ground), the lifting system to be more easily slid into place for intended inflation. Further, the middle portion 220 the base plate structure 201 may provide a high friction surface such that, when the lifting device 100 is in an inflated configuration, the lifting device 100 may push down on the middle portion 220, keeping the lifting system in place via friction. In some examples, the placement device may also comprise one or more bar segments 245 on a second side of the base plate structure 201, for example, at an end of an "X" point. Bar segments 245 may be configured to act as tie-downs or otherwise allow other components to be fastened to the base.

Figure 7B:
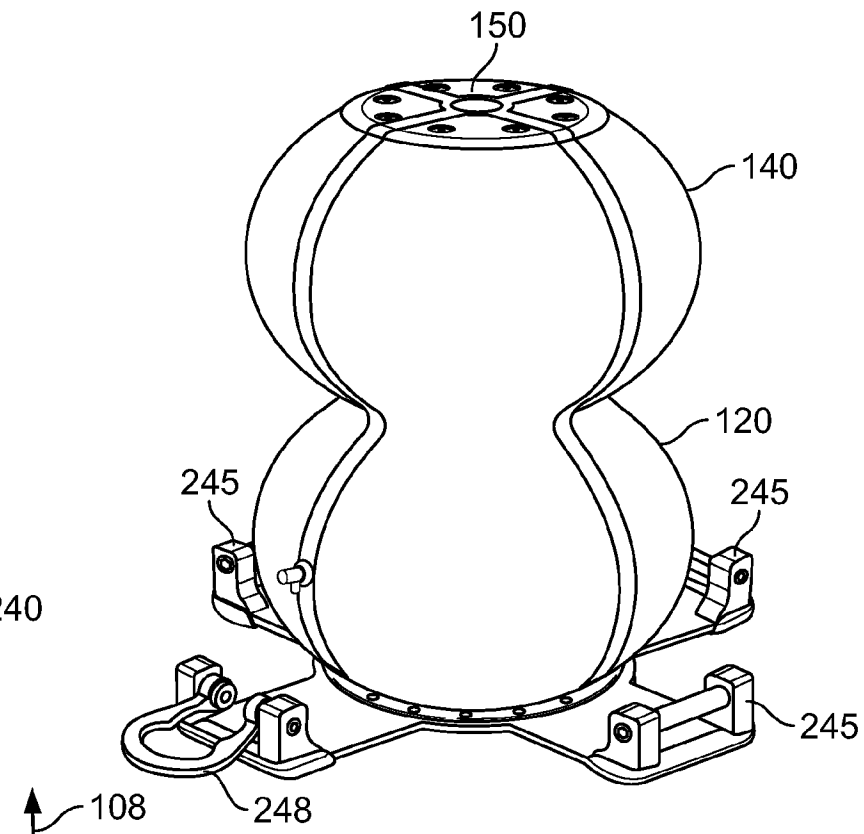
FIGS. 7A and 7B depict isometric views of a lifting device system with placement devices respectively having a transport assembly (7A) and an anchor ring (7B), according to one or more aspects described herein.
Figure 7A:
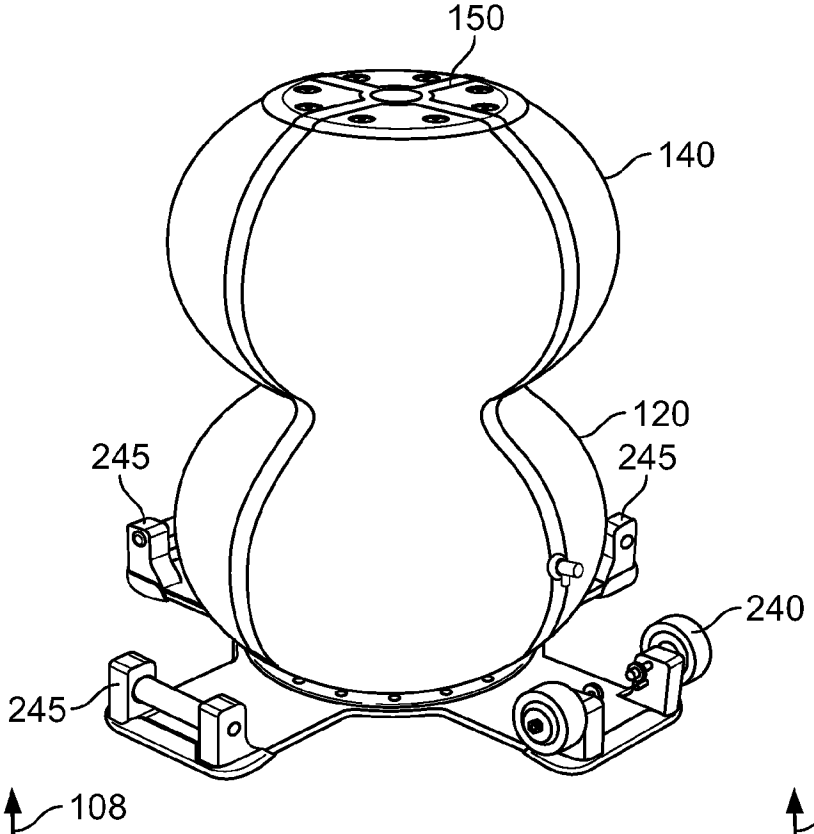

FIGS. 7A and 7B schematically depict an isometric view of a lifting system with a lifting device 100 in an inflated configuration. The placement device 200 may be positioned below the lifting device 100 in the first direction 108 when the lifting device 100 is positioned to lift an object, i.e., by expanding to an inflated configuration. As depicted in FIG. 7A, the placement device 200 may include bar segments 245, and a transport assembly 240 for use in assisting the movement of the placement device until reaching the location where the lift is to be performed, but where these components are positioned opposite of a lifting surface (e.g. the ground) when the lifting device 100 is in the inflated configuration. Alternatively, as depicted in FIG. 7B, the placement device may include an anchor ring 248 configured to act as a tie down, or configured to receive a user's hand to pick up, carry, and/or position the lifting system in place.

Figure 8:
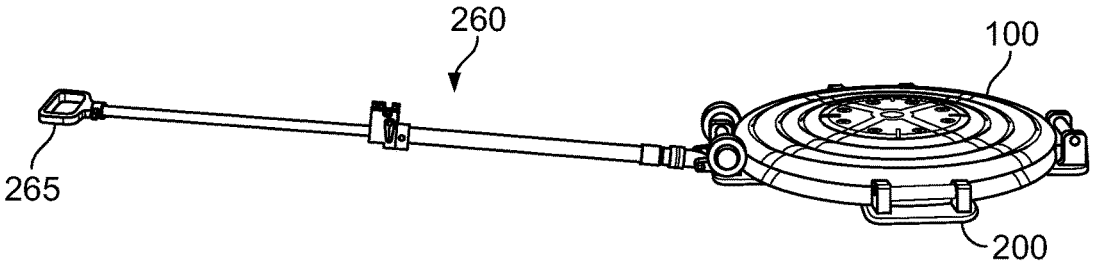
FIG. 8 schematically depicts a lifting device system with a placement device having a handle portion, according to one or more aspects described herein.

In one example, the placement device 200 may be configured to allow a user to position the lifting device 100 into place for lifting an object while maintaining a certain distance between a user and the object to be raised. As such, the placement device 200 may include a handle 260, coupled to a portion of the placement device, e.g., proximate to a transport assembly 240 as depicted in FIG. 6B. In one example the handle 260 may be a telescoping handle having an adjustable length. The length of the handle may be adjusted to approximately 60 inches, to approximately 72 inches, to approximately 120 inches, and the like. The handle 260 may be detachable from a portion of the placement surface to which it is coupled to. Thus in some examples, the handle 260 may be attached to the placement device when positioning the lifting system into place and may be removed prior to expanding the lifting device 100 to an inflated configuration. For example, as depicted in FIG. 8, the placement device 200 may be pushed into place using handle 260 where slider assemblies 210 reduce friction between a lifting surface, e.g., the ground, and the lifting system. Accordingly, in some examples the one or more slider assemblies 210 may slide along the surface for final positioning of the lifting system into placement for inflation, and then the inflation results in engagement of the one or more frictional surfaces.

When the handle 260 is not in use, it may be tied or coupled to a side or other portion of the placement device to keep the handle in place. For example, as depicted in FIG. 6B, the handle 260 includes an end handle portion 265 configured to receive a user's hand. The end handle portion may lock into place over a portion of the placement device 200 at an end of the base plate structure 201 to which an opposite end of the handle 260 is attached.

Figure 9:
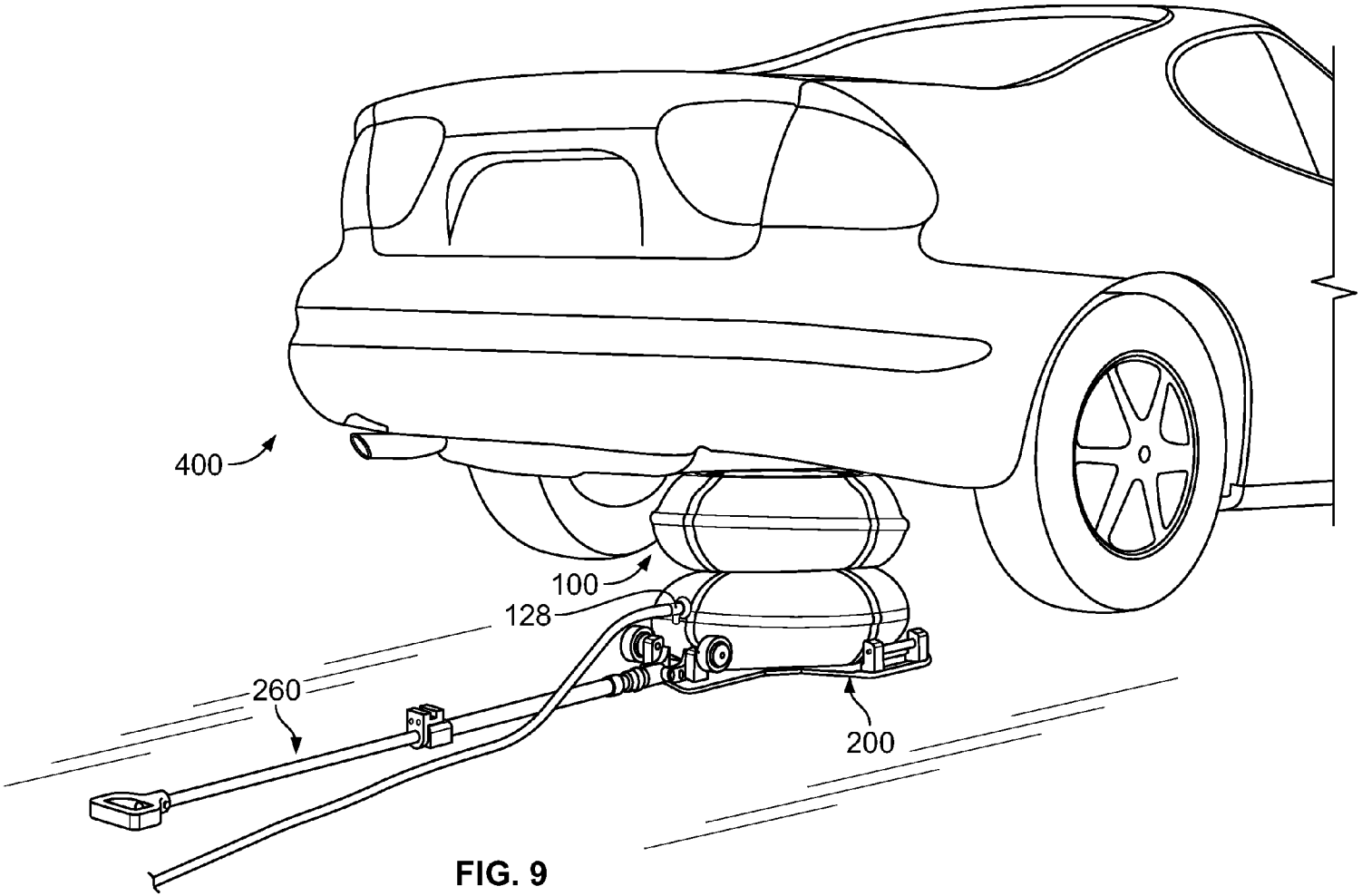
FIG. 9 schematically depicts a lifting device system used to lift a portion of an object, according to one or more aspects described herein.

FIG. 9 schematically depicts a lift system with lifting device 100 and placement device 200 used to lift a portion of an object 400. In one implementation, the lifting device 100 may be positioned on the placement device 200 in order to position the lifting device 100 in place under the object 400, e.g., using handle 260 to push the lifting system into place. In one implementation, object 400 may be a portion of a vehicle (e.g. a crashed vehicle), or a portion of a collapsed structure, among others. In one example, the lifting device 100 may lift object 400 by a height 410 when the lower and upper sections of the lifting device 100 are in the inflated configuration, e.g., by filling the lifting device with compressed air via inlet 128. As such, the lifting device 100 may lift the object 400 by a height of ½*(height 410), e.g., when a lower section 120 of the lifting device 100 is in the inflated configuration and when an upper section 140 of the lifting device 100 is in the deflated configuration. In one implementation, the placement device 200 may provide enhanced structural stability by means of the cross-sectional area of the base plate structure 201 as described above.

In one example, lift system may include a gas source. In one implementation, gas source may be an air source and may be embodied with any materials and/or dimensions configured to store pressurized air, e.g., a pressurized canister of air. In another implementation, the gas source may be configured to store pressurized oxygen, nitrogen, helium, or another gas that may be utilized to inflate a lifting device 100. A pressure regulator may be utilized, and the pressure regulator may comprise a mechanism configured to reduce a high internal gas pressure within the gas source down to a working pressure that may be utilized to inflate a lifting device 100. Accordingly, the pressure regulator may be embodied with any specific pressure regulator designs/mechanisms, without departing from the scope of these disclosures. An interconnecting hose may be used to deliver pressurized gas between a pressure regulator and a controller mechanism. As such, the interconnecting hose may comprise any length or inner/outer diameters configured to handle a pressurized gas stored within source. Controller mechanism may comprise one or more manually operated controls as well as one or more output meters (e.g. pressure meters) configured to allow a user to manually control flow of gas into, or out from the lifting device 100. Additionally, a safety valve, e.g., a pressure relief valve, may be included to keep the lifting device 100 in an inflated configuration (e.g. the inflated configuration depicted in FIG. 1) when the controller mechanism, and/or the interconnecting hose, the regulator, and the source, are disconnected from the lifting device. In another example, the safety valve may be configured to relieve excess pressure within a lower section 120 and/or upper section 140 due to shifting loads and/or temperature changes associated with the lifting device 100.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. A lifting system comprising:

a lifting bag configured to expand in a first direction between a deflated configuration and an inflated configuration upon being filled with compressed gas, the lifting bag comprising:

a continuous surface including a bottom surface, a lower intermediate surface, an upper intermediate surface, and a top surface, the bottom and lower intermediate surfaces defining a lower section, and the top and upper intermediate surfaces defining an upper section positioned above the lower section along the first direction;

a bottom plate coupled to at least part of bottom surface; and a top plate coupled to at least part of the top surface;

wherein, when the lifting bag is in the deflated configuration, the continuous surface includes a plurality of surface undulations that provide a low height profile of the lifting bag, the plurality of surface undulations having a height varying between a first deflated undulation height and a second deflated undulation height; and wherein, when the lifting bag is in the inflated configuration, the continuous surface has a relatively smoother surface as compared to the continuous surface in the deflated configuration, and wherein a relative difference between the first and second deflated undulation heights is greater than a relative height difference of any remaining features of the surface undulations, and wherein the lifting bag has a higher height profile in the inflated configuration.

2. The lifting system of claim 1, wherein the top plate comprises an interior top plate coupled to an exterior top plate, and wherein the at least part of the top surface is compressed between the exterior and interior top plates, and wherein the bottom plate comprises an interior bottom plate coupled to an exterior bottom plate, and wherein the at least part of the bottom surface is compressed between the exterior and interior bottom plates.

3. The lifting system of claim 1, wherein the lower section and the upper section are substantially spherically shaped when the lifting bag is in the inflated configuration.

4. The lifting system of claim 1, wherein the bottom plate and top plate comprise raised dimple structures, and wherein the top plate remains substantially parallel to the bottom plate as the lifting bag expands between the deflated configuration and the inflated configuration.

5. The lifting system of claim 1, wherein the lifting bag surface comprises an aramid-reinforced neoprene.

6. The lifting system of claim 1, wherein the lifting bag further comprises a middle plate disposed between the lower section and the upper section, the middle plate being configured to resist an internal pressure exerted by a mass of air within the lower section.

7. The lifting system of claim 6, wherein the middle plate comprises a relief valve configured to provide pressurized gas from the lower section into the upper section upon the lower section reaching an inflated internal pressure value.

8. The lifting system of claim 1, wherein, when the lifting bag is in the deflated configuration, the lower intermediate surface folds over the bottom surface, and the top surface folds over the upper intermediate surface.

9. The lifting system of claim 1, further comprising a placement device, the placement device comprising a base plate structure including one or more slider assemblies on a first side of the plate structure, a second side of the plate structure, and a handle connected to the base plate structure.

10. The lifting system of claim 9, wherein a length of the base plate structure is at least as long as a diameter of the lifting bag, and wherein the base plate structure further includes a frictional surface on a middle portion of the first side, the frictional surface configured to provide friction between the placement device and a surface the placement device is resting on when the lifting bag is in the inflated configuration.

11. A lifting device, comprising:

a lower section defining a lower chamber, the lower section configured to expand in a first direction between a deflated configuration and an inflated configuration upon being filled with compressed gas, the lower section comprising a top surface and a bottom surface, the top and bottom lower section surfaces including, when the lower section is in the deflated configuration, a plurality of surface formations, a height of the lower section surface formations varying between a first formation height and a second formation height; and an upper section defining an upper chamber, the upper section configured to expand in a first direction between a deflated configuration and an inflated configuration upon being filled with a compressed gas, the upper section comprising a top surface and a bottom surface, the top and bottom upper section surfaces including, when the upper section is in the deflated configuration, a plurality of surface formations, a height of the upper section surface formations varying between the first formation height and the second formation height;

wherein the top surface of the lower section is coupled to the bottom surface of the upper section; and wherein the lower section and upper section have a combined first height when each is in the deflated configuration, and a combined first exterior surface area when each is in the deflated configuration;

wherein the lower section and upper section have a combined second height when each is in the inflated configuration, and a combined second exterior surface area when each is in the inflated configuration;

wherein the combined second height exceeds the combined first height;

and wherein the first exterior surface area is substantially equal to the second exterior surface area.

12. The lifting device of claim 11, wherein a ratio of the combined second height to the combined first height is at least 7.

13. The lifting device of claim 11, wherein the combined first height is between approximately of 2.5 inches and 5.0 inches, and wherein the combined second height is approximately 20 inches to 60 inches.

14. The lifting device of claim 11, wherein the lifting device further comprises a bottom plate coupled to at least part of the bottom surface of the lower section, and a top plate coupled to at least part of the top surface of the upper section, wherein at least one of the plates comprises a relief valve configured to release pressurized gas out of the lifting device if an internal pressure of the lifting device meets or exceeds a maximum pressure.

15. The lifting device of claim 11, wherein an internal pressure in the lower chamber, the upper chamber, or both, reaches approximately 150 psi when in the inflated configuration.

16. The lifting device of claim 11, wherein the plurality of surface formations on the lower section and the upper section comprise a plurality of undulations.

17. The lifting device of claim 11, further comprising a middle plate disposed between the lower chamber and the upper chamber configured to substantially restrict airflow from passing therethrough.

18. The lifting device of claim 11, further comprising a middle plate disposed between the lower chamber and the upper chamber, wherein the middle plate further comprises a first relief valve configured to provide pressurized air from the lower chamber into the upper chamber upon the lower chamber reaching an inflated internal pressure value, and a second relief valve configured to provide pressurized air from the upper chamber to the lower chamber upon the lower chamber having a lower relative internal pressure than the upper chamber, the middle plate otherwise being configured to restrict airflow from passing therethrough.

19. The lifting device of claim 11, wherein, when the lower section and the upper sections are in the deflated configuration, the top section surfaces fold on top of the bottom section surfaces.

20. A lifting device, comprising:

a lifting bag configured to expand in a first direction between a deflated configuration and an inflated configuration upon being filled with compressed gas, the lifting bag comprising a top surface and a bottom surface;

a top plate coupled to the top surface of the lifting bag; and a bottom plate coupled to the bottom surface of the lifting bag; and wherein, when the lifting bag is in the deflated configuration, the top and bottom surfaces comprise a plurality of undulating arcs between a first edge defining an interior circumference of the lifting bag and a second edge defining an exterior circumference of the lifting bag;

wherein, when the lifting bag is in the inflated configuration, the top and bottom surfaces define a shape of a substantially circular arc between the first edge and the second edge of each surface.

21. The lifting device of claim 20, further comprising a lower intermediate surface and an upper intermediate surface between the top surface and bottom surface, wherein the bottom and lower intermediate surfaces define a lower section, and the top and upper intermediate surfaces define an upper section.

* * * * *